US005484630A

United States Patent [19]

McCall et al.

[11] Patent Number: 5,484,630

[45] Date of Patent: Jan. 16, 1996

[54] CONTAINER FOR STATUETTE

[76] Inventors: Barry S. McCall; F. Elizabeth Wall, both of 11768 S. Harrell's Ferry Rd., Ste. D, Baton Rouge, La. 70816

[21] Appl. No.: 380,287

[22] Filed: Jan. 30, 1995

[51] Int. Cl.[6] ..... G09F 19/00

[52] U.S. Cl. ..... 428/11; 428/13

[58] Field of Search ..... 428/3, 13, 11; 47/41.13

[56] References Cited

U.S. PATENT DOCUMENTS

| | | | |
|---|---|---|---|
| Re. 20,289 | 3/1937 | Simpson | 47/41.13 |
| 1,427,180 | 8/1922 | Welch | 47/41.13 |
| 2,046,854 | 7/1936 | Simpson | 47/41.13 |
| 2,155,811 | 4/1939 | Tredup | 47/41.13 |
| 2,226,950 | 12/1940 | Simpson | 47/41.13 |
| 2,226,951 | 12/1940 | Simpson | 47/41.13 |
| 2,361,424 | 10/1944 | Snyder | 428/13 |
| 2,745,948 | 5/1956 | Prest | 428/3 X |
| 3,765,995 | 10/1973 | Perrin | 47/41.13 X |

*Primary Examiner*—Henry F. Epstein
*Attorney, Agent, or Firm*—Reginald F. Roberts, Jr.

[57] ABSTRACT

A container for displaying a statuette. The container includes a transparent hollow globe which is attachable to and detachable from the base. The globe and the base form a seal when attached to one another, so that water can be used to magnify the image of the statuette. The flat upper surface of the base has perforations in which floral wire can be inserted, for attaching the statuette to the base.

8 Claims, 1 Drawing Sheet

CONTAINER FOR STATUETTE

BACKGROUND OF THE INVENTION

The present invention relates to artistic displays. More particularly, the invention relates to a container for displaying a statuette.

The prior art provides containers suitable for displaying flowers; see, for example U.S. Pat. Nos. 1,427,180; 2,046,854; Re. 20,289; 2,155,811; 2,226,950; 2,226,951; and 3,765,995. What the prior art fails to provide is a container suitable for displaying a statuette. The present invention provides such a container.

SUMMARY OF THE INVENTION

In general, the present invention provides a container for a statuette. The container comprises a transparent hollow member, and a base attachable to and detachable from the hollow member. The base has a central, uniformly-flat upper surface which is the highest portion of the base, which defines a horizontal plane, which extends upward into the interior of the hollow member, and which has a surface area equal to at least about one-fourth of the cross-sectional area of the hollow member across the plane defined by the flat upper surface of the base. Means are provided for attaching the statuette to the flat upper surface of the base, thereby providing a completely unobstructed view of the statuette from all directions.

DETAILED DESCRIPTION OF THE INVENTION

Figure 2:
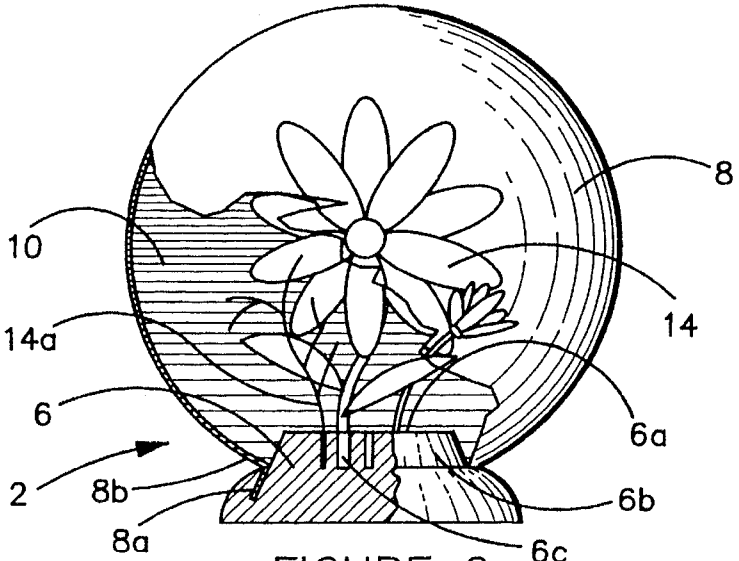
FIG. 2 is a front view, partially cut away, of the container shown in FIG. 1, in which a flower is attached to the base of the container.
Figure 1:
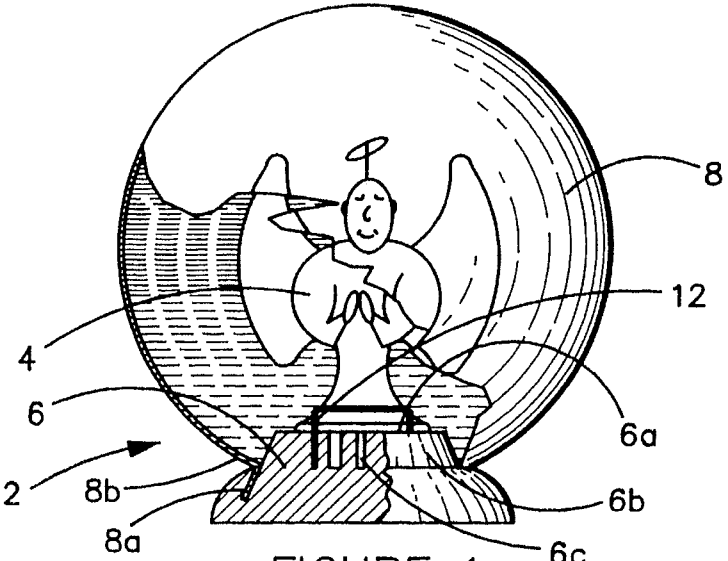
FIG. 1 is a front view, partially cut away, of a container for a statuette, made in accordance with the principles of the present invention, in which a statuette is attached to the base of the container.
Figure 3:
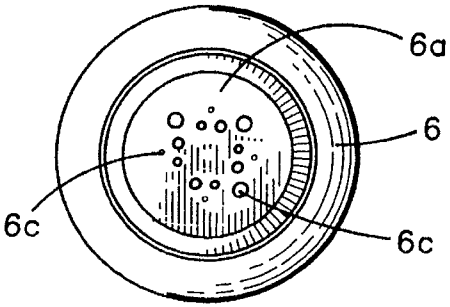
FIG. 3 is a top plan view of the base of the container shown in FIGS. 1 and 2.

More Specifically, reference is made to FIGS. 1–3, in which is shown a container, generally designated by the numeral 2, made in accordance with the principles of the present invention, for a statuette 4. The container 2 comprises a base 6 having a flat upper surface 6*a*, and a transparent hollow globe 8. When the base 6 and globe 8 are attached to one another, they form a seal whereby water 10 may be used to fill the globe 8. Any suitable means of attachment such as matching threads (not shown) on the outer surface of the base 6 and inner surface of the globe 8 may be used.

The flat upper surface 6*a* and the upper portion 6*b* of the base 6 are perforated, whereby the statuette 4 may be attached to the flat upper surface 6*a* of the base 6 by wrapping floral wire 12 around the base of the statuette 4 and inserting the wire 12 in the perforations 6*c*, as shown in FIG. 1. Alternatively, floral clay (not shown) may be used to attach the statuette 4 to the flat surface 6*a*. Stems 14*a* of a flower or plant 14 can be inserted in the perforations 6*c* to attach the flower or plant 14 to the fiat surface 6*a* of the base 6, as shown in FIG. 2.

When the globe 8 is filled with water 10, the observed image of the statuette 4 or flower 14 is significantly magnified.

The base 6 is beneficially fabricated from a plastic or an elastomer. It may, for example, be made from polyvinyl chloride or from rubber. The flat upper surface 6*a* of the base 6 is preferably about three and one-quarter inches in diameter.

The transparent globe 8 is preferably made of glass or of polymethyl methacrylate, commonly known as Plexiglass.

The preferred depth of the perforations 6*c* in the upper portion 6*b* of the base 6 is about one-half inch. The perforations 6*c* may be of the same width, or of different widths. While the number of perforations 6*c* may vary greatly, about five perforations 6*c* is optimum.

The globe 8 preferably has a straight stem 8*a* and a small lip 8*b* at its bottom edge, where it joins the base 6. The base 6 preferably has a slot (not shown) in which the straight stem 8*a* is disposed, thereby sealing the container 2. The slot (not shown) and straight stem 8*a* preferably define an angle of approximately ten degrees with a vertical plane. Matching threads (not shown) in the slot (not shown) and stem 8*a* are beneficially used to form a tight seal.

The globe 8 is preferably about six inches in diameter. The upper flat surface 6*a* preferably extends about one-quarter of an inch above the straight stem 8*a* into the lip 8*b* at the bottom edge of the globe 8, so that the entire statuette 4 or flower 14 is visibly displayed.

Preferably, the flat upper surface 6*a* of the base 6 has a surface area equal to at least about one-third of the cross-sectional area of the globe 8 across the plane defined by the flat upper surface 6*a* of the base 6. Even more preferably, the flat upper surface 6*a* of the base 6 has a surface area equal to at least about one-half of the cross-sectional area of the globe 8 across the plane defined by the flat upper surface 6*a* of the base 6. Even more preferably, the flat upper surface 6*a* of the base 6 has a surface area equal to at least about two-thirds of the cross-sectional area of the globe 8 across the plane defined by the flat upper surface 6*a* of the base 6. Even more preferably, the flat upper surface 6*a* of the base 6 has a surface area equal to at least about three-fourths of the cross-sectional area of the globe 8 across the plane defined by the flat upper surface 6*a* of the base 6. Most preferably, the entire upper surface 6*a* of the base 6 is completely and uniformly flat.

In the "BACKGROUND" section of this application, the inventors stated that the prior art fails to provide a container suitable for displaying a statuette, and that the present invention provides such a container. These statements are based on the following considerations.

The present invention includes a base 6 having a central, uniformly-flat upper surface 6*a* which is the highest portion of the base 6. These characteristics are critical to a container which provides a completely unobstructed view of the entire statuette from all directions.

By way of illustration, reference is made to U.S. Pat. Nos. 2,046,854 and Re. 20,289 to Simpson. The spring clips 7 shown in FIGS. 1 and 2, and the spring clip shown in FIG. 4 for holding a flower or flowers, would obstruct the view of a statuette from at least some of the directions from which the statuette could be viewed.

The requirement of a flat surface derives from the consideration that statuettes have flat bases. Thus, the convex upper surface of the base e of the urn disclosed by U.S. Pat. No. 1,427,180 to Welch is clearly unsuitable and impractical for attachment of a statuette thereto.

Not only must the upper surface 6a of the base 6 be uniformly flat; it must also provide a surface area sufficient to provide a stable attachment of the statuette 4 thereto. The minimum surface area required is about one-fourth of the cross-sectional area of the globe 8 across the plane defined by the flat upper surface 6a of the base 6.

It will be apparent that, even were it flat, the surface area of the stud 9 described in U.S. Pat. No. 2,155,811 to Tredup would be grossly inadequate for the stable attachment thereto of a statuette.

I claim:

1. A container for a statuette, comprising:

(a) a transparent hollow member;

(b) a base having a central, uniformly-flat upper surface which is the highest portion of the base, which defines a horizontal plane, which extends upward into the interior of the hollow member, which has a surface area equal to at least about one-fourth of the cross-sectional area of the hollow member across the plane defined by the flat upper surface of the base, and which is attachable to and detachable from the transparent hollow member; and (c) means for attaching the statuette upright to the flat upper surface of the base, said means including floral wire, thereby providing a completely unobstructed view of the entire statuette from all directions.

2. The container of claim 1, wherein the means for attaching the statuette to the flat upper surface of the base include perforations in the flat surface of the base, whereby the floral wire can be wrapped around the statuette and inserted in the perforations of the base.

3. The container of claim 1, wherein the base and the hollow member form a seal when they are attached to one another.

4. The container of claim 1, wherein the flat upper surface of the base has a surface area equal to at least about one-third of the cross-sectional area of the hollow member across the plane defined by the flat upper surface of the base.

5. The container of claim 1, wherein the flat upper surface of the base has a surface area equal to at least about one-half of the cross-sectional area of the hollow member across the plane defined by the flat upper surface of the base.

6. The container of claim 1, wherein the flat upper surface of the base has a surface area equal to at least about two-thirds of the cross-sectional area of the hollow member across the plane defined by the flat upper surface of the base.

7. The container of claim 1, wherein the flat upper surface of the base has a surface area equal to at least about three-fourths of the cross-sectional area of the hollow member across the plane defined by the flat upper surface of the base.

8. The container of claim 1, wherein the entire upper surface of the base is completely and uniformly flat.

* * * * *